US005537980A

United States Patent [19]

Yamamoto

[11] Patent Number: 5,537,980

[45] Date of Patent: Jul. 23, 1996

[54] HIGH PRESSURE FUEL INJECTION SYSTEM FOR INTERNAL COMBUSTION ENGINE

[75] Inventor: Kazuo Yamamoto, Nagoya, Japan

[73] Assignee: Nippondenso Co., Ltd., Japan

[21] Appl. No.: 352,209

[22] Filed: Dec. 2, 1994

[30] Foreign Application Priority Data

Dec. 3, 1993 [JP] Japan ..... 5-304320

[51] Int. Cl.$^6$ ..... F02M 7/04

[52] U.S. Cl. ..... 123/447; 123/456; 123/514

[58] Field of Search ..... 123/447, 456, 123/506, 514, 198 DB, 179.17, 452–454

[56] References Cited

U.S. PATENT DOCUMENTS

| | | | |
|---|---|---|---|
| 4,170,204 | 10/1979 | Badber | 123/454 |
| 4,565,170 | 1/1986 | Grieshaber | 123/198 DB |
| 4,732,131 | 3/1988 | Hensel | 123/514 |
| 4,782,808 | 11/1988 | Bostick | 123/514 |
| 4,957,084 | 9/1990 | Kramer | 123/447 |
| 5,088,463 | 2/1992 | Affeldt | 123/459 |
| 5,425,342 | 6/1995 | Ariga | 123/456 |

FOREIGN PATENT DOCUMENTS

| | | | |
|---|---|---|---|
| 0200663 | 12/1982 | Japan | 123/516 |
| 0048768 | 3/1983 | Japan | 123/516 |
| 0091363 | 5/1983 | Japan | 123/514 |
| 64-36977 | 2/1989 | Japan . | |

*Primary Examiner*—Carl S. Miller
*Attorney, Agent, or Firm*—Cushman Darby & Cushman

[57] ABSTRACT

A high pressure fuel injection system for an internal combustion engine includes a fuel feed pump which pressurizes fuel to a given feed pressure during the engine being operated, while immediately stops pressurizing the fuel when the engine is stopped. The system further includes a high pressure supply pump connected in series to the fuel feed pump for further pressurizing the fuel supplied from the fuel feed pump to a higher pressure. The system further includes a high pressure fuel reservoir which receives the high pressure fuel from the high pressure supply pump and supplies it to fuel injection valves for injection therefrom. A pressure relief valve is connected to the high pressure fuel reservoir at its one side and to the fuel feed pump at its other side. The pressure relief valve is arranged to be held closed when the given feed pressure is applied thereto from the fuel feed pump, that is, when the engine is operated. On the other hand, the pressure relief valve is arranged to be immediately opened to release the pressure in the high pressure fuel reservoir in response to absence of the given feed pressure from the fuel feed pump, that is, when the engine is stopped. With this arrangement, leakage of the high pressure fuel via the fuel injection valves is effectively prevented.

5 Claims, 2 Drawing Sheets

HIGH PRESSURE FUEL INJECTION SYSTEM FOR INTERNAL COMBUSTION ENGINE

BACKGROUND OF THE INVENTION

1. Field of the Invention

The present invention relates to a high pressure fuel injection system suitable for an internal combustion engine of a type where fuel, such as, gasoline is highly pressurized and injected directly into engine cylinders.

2. Description of the Prior Art

Japanese First (unexamined) Patent Publication No. 64-36977 discloses a fuel injection system for an internal combustion engine. In this publication, the system includes a pressure regulating valve for adjusting a pressure of fuel supplied to fuel injection valves depending on a boost pressure (negative pressure) in an intake manifold of the engine, and further includes a mechanism for preventing leakage of the fuel out of the fuel injection valves when the engine is stopped. Specifically, the disclosed system relates to a low pressure fuel injection system for the engine of a type where the fuel is pressurized to a relatively low pressure, such as, about 0.2 MPa to 0.3 MPa and injected into the intake manifold. After the engine is stopped, the boost pressure reaches an atmospheric pressure and thus a pressure in a-control pressure chamber in the pressure regulating valve which introduces the boost pressure also becomes the atmospheric pressure. On the other hand, a fuel pump continues to rotate due to inertia for a short while after the engine is stopped. This results in increase of a discharge pressure of the fuel pump to the maximum extent, and thus further results in leakage of the highly pressurized fuel out of the fuel injection valves to wet inner walls of the intake manifold. This causes the overly-enriched fuel to deteriorate the start-up operation of the engine, particularly under a condition where the fast idle is required. In order to prevent such leakage of the fuel, the disclosed system provides a valve unit in a signal conduit connecting between the control pressure chamber of the pressure regulating valve and a boost pressure introducing port provided at the intake manifold. The valve unit is closed when the engine is stopped. This causes the boost pressure introduced into the control pressure chamber of the pressure regulating valve up to the engine stop to be trapped therein so that the trapped boost pressure is held at least for a certain time after the engine stop.

As described above, the disclosed system relates to the low pressure fuel injection system where the fuel pressure is about 0.2 MPa to 0.3 MPa. This makes it possible to control the fuel pressure using the boost pressure as one of the control factors. On the other hand, in a high pressure fuel injection system for an internal combustion engine of a type where fuel, such as, gasoline is pressurized to near 10 MPa and injected directly into combustion chambers of engine cylinders, a boost pressure is not used for controlling a pressure of the fuel. Accordingly, in the high pressure fuel injection system, the foregoing conventional technique can not be used to prevent leakage of the fuel from the fuel injection valves when the engine is stopped.

In the high pressure fuel injection system, when the engine is stopped, the high pressure fuel held in a fuel piping is heated to a high temperature due to remaining heat of the engine so as to be expanded. As a result, the fuel is likely to leak out through injection holes of the fuel injection valves into the engine cylinders. The leaked fuel may be converted to carbon and adhere to walls of the combustion chambers in the form of carbon deposit. Further, the leaked fuel may increase an amount of contaminants or harmful components in the exhaust gas when the engine is restarted.

SUMMARY OF THE INVENTION

Therefore, it is an object of the present invention to provide an improved high pressure fuel injection system for an internal combustion engine, which can effectively prevent leakage of fuel via injection holes of fuel injection valves by dropping a pressure of the fuel immediately when the engine is stopped.

According to one aspect of the present invention, a high pressure fuel injection system for an internal combustion engine comprises a fuel feed pump driven to pressurize fuel to a relatively low given feed pressure during the engine being operated, the fuel feed pump immediately allowed to be stopped when the engine is stopped; a high pressure supply pump connected in series to the fuel feed pump for further pressurizing the fuel supplied from the fuel feed pump; high pressure fuel storage means for storing the further pressurized fuel supplied from the high pressure supply pump; a fuel injection valve supplied with the further pressurized fuel from the high pressure fuel storage means to inject it for supply to the engine; and a pressure relief valve connected to the high pressure fuel storage means, the pressure relief valve receiving the given feed pressure of the fuel from the fuel feed pump so as to be held closed during the engine being operated, while the pressure relief valve is opened, when the engine is stopped, in response to absence of the given feed pressure due to the stop of the fuel feed pump for dropping a pressure of the further pressurized fuel in the high pressure fuel storage means.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, a preferred embodiment of the present invention will be described hereinbelow with reference to the accompanying drawings.

Figure 1:
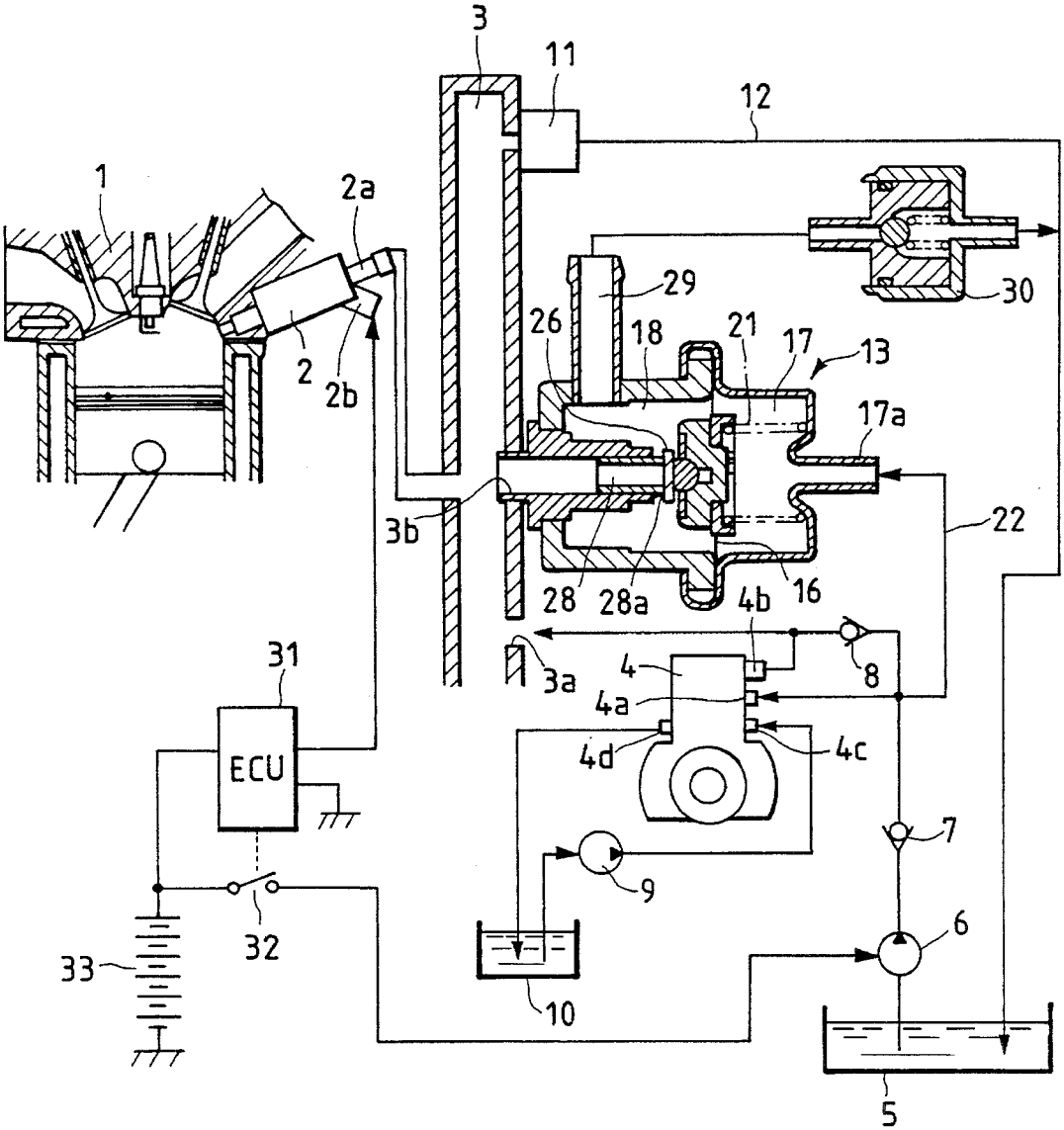
FIG. 1 is a diagram schematically showing a structure of a high pressure fuel injection system for an internal combustion engine according to a preferred embodiment of the present invention.

FIG. 1 is a diagram schematically showing a structure of a high pressure fuel injection system for an internal combustion engine according to the preferred embodiment. In this preferred embodiment, the high pressure fuel injection system is applied to the engine of a type where high pressure gasoline is directly injected into engine cylinders.

In FIG. 1, numeral 1 represents the engine having a cylinder head in which fuel injection valves 2 are fixedly mounted with their injection holes exposed to combustion chambers of the corresponding engine cylinders, respectively. Each of the fuel injection valves 2 injects fuel (gasoline) pressurized to about 10 MPa directly into the combustion chamber of the corresponding engine cylinder. Fuel inlets 2*a* of the fuel injection valves 2 are connected to common high pressure fuel storage means, that is, a common high pressure fuel reservoir tube 3 in this preferred embodiment, respectively, so as to be supplied with high pressure fuel therefrom. On the other hand, the high pressure fuel reservoir tube 3 has an inlet 3*a* to which the fuel highly pressurized by a high pressure supply pump 4 is supplied. The high pressure supply pump 4 is driven to rotate by means of a crankshaft (not shown) of the engine 1.

Specifically, the fuel in a fuel tank 5 is first pressurized to a given feed pressure, which is relatively low, by a motor-driven fuel feed pump 6, and then supplied to the high pressure supply pump 4 where the fuel is further pressurized to a higher pressure. In a fuel passage between the fuel feed pump 6 and an inlet port 4*a* of the high pressure supply pump 4 is interposed a check valve 7 which allows the fuel to flow only in a direction from the fuel feed pump 6 to the inlet port 4*a*, that is, only in a fuel supply direction. On the other hand, a discharge port 4*b* of the high pressure supply pump 4 is connected to the inlet 3*a* of the high pressure fuel reservoir tube 3 for introducing the high pressure fuel into the reservoir tube 3. Further, in a fuel passage extending from a downstream side of the cheek valve 7 to a downstream side of the discharge port 4*b* of the pump 4 and bypassing the pump 4 is interposed a check valve 8 for allowing the fuel to flow only in a direction from the downstream side of the cheek valve 7 to the downstream side of the discharge port 4*b*.

Numeral 9 represents a lubricating oil pump which pressurizes lubricating oil in a lubricating oil tank 10 and supplies it to a lubricating oil inlet port 4*c* of the pump 4. The supplied lubricating oil lubricates sliding parts in the pump 4 and then is discharged from a lubricating oil outlet port 4*d* so as to return to the lubricating oil tank 10.

In this preferred embodiment, since gasoline used as fuel has substantially no lubricity on a practical basis, the lubricating oil is separately supplied using the lubricating oil pump 9. Accordingly, when gas oil or the like having substantial lubricity is used as fuel, it may be possible not to supply the lubricating oil to the high pressure supply pump 4.

As is well known, under the normal operating condition of the engine 1, a pressure of the fuel in the high pressure fuel reservoir tube 3 is automatically controlled to a given value by means of a pressure-reduction adjustment performed by a fuel pressure control valve 11 which .opens or closes a bypass passage provided in the reservoir tube 3. The fuel discharged via the bypass passage due to the pressure-reduction adjustment is returned to the fuel tank 5 via a return fuel passage 12.

A pressure relief valve 13 is mounted to a pressure relief port 3*b* of the reservoir tube 3. The pressure relief valve 13 is provided for dropping a fuel pressure in the reservoir tube 3 to a given value rapidly when the engine 1 is stopped so as to prevent leakage of the fuel from between needle valves (not shown) and valve seats (not shown) of the fuel injection valves 2.

Figure 2:
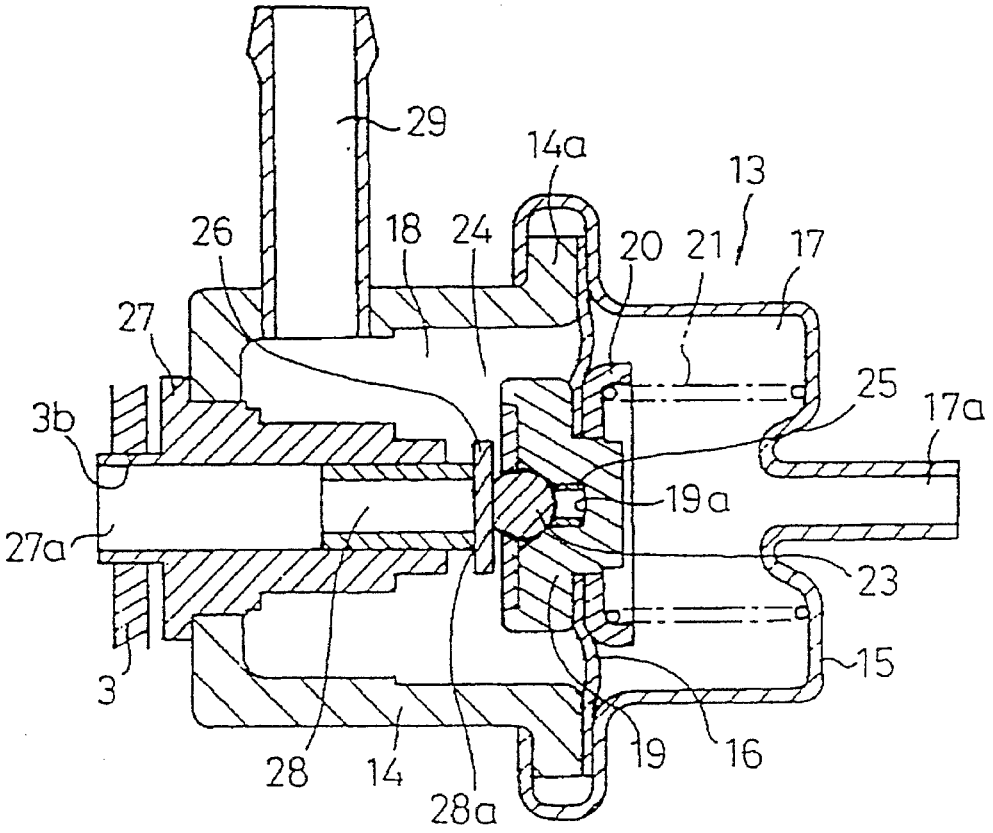
FIG. 2 is a sectional view showing a pressure relief valve shown in FIG. 1 on an enlarged scale.

As shown in FIG. 2 on an enlarged scale, a housing of the pressure relief valve 13 includes a body 14 and a cover 15 which have essentially bottomed-cylindrical shapes, respectively. An annular outward flange 14*a* is formed at an open end of the body 14. An open end of the cover 15 is coupled to the flange 14*a* of the body 14 by caulking as enclosing the flange 14*a*, so as to form a fixedly assembled unit of the body 14 and the cover 15. When coupling the body 14 and the cover 15, a peripheral edge of a disk-shaped diaphragm 16 made of, such as, rubber is fixed to the flange 14*a* of the body 14. The diaphragm 16 divides an interior space of the pressure relief valve 13 into a pressure receiving chamber 17 and a pressure relief chamber 18. The diaphragm 16 may be replaced by a bellows.

At the center of the diaphragm 16, a valve member 19 and a spring seat 20 are fixedly mounted. A compression spring 21 is disposed between the spring seat 20 and a bottom of the cover 15. At the bottom of the cover 15, a feed pressure introducing inlet 17*a* is provided for connection to a feed pressure introducing passage 22. Accordingly, a feed pressure of the fuel, which is a discharge pressure of the fuel feed pump 6, is introduced into the pressure receiving chamber 17 from the fuel passage extending between the check valves 7 and 8. As appreciated from FIG. 1, this feed pressure is also applied to the inlet port 4*a* of the high pressure supply pump 4.

The valve member 19 is formed at its center with a recess 19*a* of essentially a funnel shape. A ball 23 of essentially a truncated-sphere shape is slidably received in the recess 19*a* with a portion thereof at a truncated side protruding therefrom. A disk-shaped member 24 having a central hole is fixed to the valve member 19 at an open side of the recess 19*a* by caulking. The central hole of the disk-shaped member 24 allows the ball 23 to partly protrude therefrom, while prohibits the ball 23 from escaping from within the recess 19*a*. The ball 23 is urged toward the central hole of the disk-shaped member 24 due to a biasing force of a compression spring 25 provided at a bottom of the recess 19*a*. The ball 23 is arranged to be rotatable as being pressed against the central hole of the disk-shaped member 24. Further, a disk-shaped valve body 26 is welded to a truncated surface of the ball 23 so that the disk-shaped valve body 26 is tiltable as being supported by the ball 23 which is rotatable. With this arrangement, the valve body 26 can hermetically abut against a surface of a later-described valve seat 28*a* so that leakage of the fuel from between the valve seat 28*a* and the valve body 26 is reliably avoided.

The pressure relief valve 13 further includes a valve member 27 which is received through a center opening of the body 14. Specifically, the valve member 27 is hermetically fixed to the body 14 by screw engagement and extends into the pressure relief chamber 18. The valve member 27 is formed with a high pressure fuel passage 27*a* extending through the center of the valve member 27. A relatively short valve seat tube 28 is inserted and fixed at a right end, in the figure, of the high pressure fuel passage 27*a*. A right end, in the figure, of the valve seat tube 28 works as the valve seat 28*a* for the foregoing disk-shaped valve body 26. On the other hand, at a left end, in the figure, of the high pressure fuel passage 27*a*, the valve member 27 is hermetically and fixedly received in the pressure relief port 3*b* of the high pressure fuel reservoir tube 3 so that the high pressure fuel passage 27*a* communicates with the reservoir tube 3. With this arrangement, the high fuel pressure as applied to the fuel inlets 2*a* of the fuel injection valves 2 is also applied at the valve seat 28*a* from the reservoir tube 3 through the high pressure fuel passage 27*a* and the valve seat tube 28.

The pressure relief chamber 18 of the pressure relief valve 13 is provided with a fuel drain port 29 which is connected to the fuel tank 5 via a check valve 30. The check valve 30 is arranged to be opened when a fuel pressure in the pressure relief chamber 18 exceeds a given residual pressure of the fuel. This allows the fuel to return to the fuel tank 5 so as to control the fuel pressure in the pressure relief chamber 18 to be constantly held at the given residual fuel pressure.

For controlling operations of the fuel injection valves 2, input terminals 2*b* of the fuel injection valves 2 are connected to a drive circuit (not shown) in an ECU (electronic control unit) 31, respectively. A drive motor of the fuel feed pump 6 is connected to a power source 33, such as, a battery, via a switch 32. The switch 32 is on-off controlled by the ECU 31. Specifically, the ECU 31 holds the switch 32 to be closed while the engine 1 is operated. On the other hand, when the engine 1 is stopped, that is, when a stopping operation for the engine 1 is performed by a driver, such as, an ignition switch is off, the ECU 31 immediately opens the switch 32 so as to stop the operation of the drive motor of the fuel feed pump 6. Accordingly, the fuel feed pump 6 stops the operation of pressurizing the fuel immediately when the engine 1 is stopped.

The lubricating oil pump 9 may be driven by either the crankshaft of the engine 1 or a motor.

Now, an operation of the high pressure fuel injection system having the foregoing structure will be described hereinbelow.

During the engine 1 being operated, the switch 32 is held closed by the ECU 31 so that the fuel feed pump 6 is driven to rotate by the power supplied from the power source 33 to pressurize the fuel in the fuel tank 5 to the given feed pressure. The pressurized fuel is then supplied to the inlet port 4*a* of the high pressure supply pump 4 via the check valve 7. The pump 4 is driven by the crankshaft of the engine 1 to pressurize the fuel to the high injection pressure of about 10 MPa for supply into the high pressure fuel reservoir tube 3 from the discharge port 4*b*.

On the other hand, the fuel pressurized to the given feed pressure by the fuel feed pump 6 is also supplied into the pressure receiving chamber 17 of the pressure relief valve 13 via the feed pressure introducing passage 22. In FIG. 2, assuming that the feed fuel pressure applied to a right side of the diaphragm 16 is p, a pressure receiving area of the diaphragm 16 for the feed fuel pressure is A, a spring load of the spring 21 is S, the pressure of the high pressure fuel in the high pressure fuel reservoir tube 3 is P, and a cross-sectional area of the fuel passage in the valve set tube 28, that is, a pressure receiving area of the valve body 26, is a, a force F which presses the valve body 26 toward the valve seat 28*a* is expressed by an equation as follows:

$$F=(p\cdot A+S)-(P\cdot a)$$

As described above, while the engine 1 is operated, the fuel feed pump 6 is driven to hold the feed fuel pressure p approximately at the given value. Accordingly, by setting the pressures P and p, the pressure receiving areas A and a, and the spring load S to appropriate values, respectively, a condition of $(p\cdot A+S)>(P\cdot a)$ and thus $F>0$ can be established during the engine 1 being operated. When such a condition is satisfied, the valve body 26 is pressed against the valve seat 28*a* by means of the pressing force F so that the pressure relief valve 13 is reliably held closed during the engine operation. As a result, although the high pressure fuel in the reservoir tube 3 is subjected to the pressure-reduction adjustment of the fuel pressure control valve 11 as described above so as to hold the fuel pressure in the reservoir tube 3 at the given value, the fuel pressure in the reservoir tube 3 is not released through the pressure relief valve 13 during the engine operation.

On the other hand, when the engine 1 is stopped, the operation of the fuel feed pump 6 is also immediately stopped as described above so that the feed fuel pressure p is rapidly dropped to 0 (zero). As a result, a condition becomes $S<(P\cdot a)$ and thus $F<0$ to cause the valve body 26 to be separated from the valve seat 28*a* so that the high pressure fuel in the reservoir tube 3 is released into the pressure relief chamber 18. Accordingly, the fuel pressure in the reservoir tube 3 is rapidly dropped to a given low pressure which is preset by the check valve 30. This simultaneously reduces the fuel pressure applied to the needle valves of the fuel injection valves 2 so as to prevent leakage of the high pressure fuel from the fuel injection valves 2 after the engine is stopped. Therefore, the generation of carbon and the adhesion of carbon deposit in the combustion chambers as well as the deterioration of emission can be effectively prevented.

When the engine 1 is restarted, the switch 32 is immediately closed to drive the fuel feed pump 6 so that the feed fuel pressure p is increased to provide the condition $F>0$. Accordingly, the pressure relief valve 13 is closed to allow the fuel pressure in the reservoir tube 3 to increase to the given high value by means of the operation of the high pressure supply pump 4. Therefore, the fuel injection is normally effected into the combustion chambers from the respective fuel injection valves 2 so that the engine 1 is driven in the normal operating condition.

As appreciated, while the engine 1 is stopped, the fuel pressure in the pressure relief chamber 18 is not reduced to 0 due to the operation of the check valve 30 which determines the minimum fuel pressure in the pressure relief chamber 18. Accordingly, since the fuel pressure in the reservoir tube 3 does not drop below the minimum fuel pressure determined by the check valve 30, the fuel pressure in the reservoir tube 3 is quickly increased to the given high pressure for the normal fuel injection. This improves the restarting performance of the engine 1.

According to the foregoing preferred embodiment, since the fuel pressure in the high pressure fuel reservoir tube 3 can be rapidly dropped to the given value when the engine 1 is stopped, leakage of the fuel into the engine cylinders via the fuel injection valves 2 is effectively prevented. As a result, an amount of contaminants is prevented from increasing in the exhaust gas when the engine 1 is restarted. Further, the generation of carbon and the adhesion of carbon deposit in the engine cylinders due to remaining heat of the engine 1 are also effectively prevented.

It is to be understood that this invention is not to be limited to the preferred embodiments and modifications described above, and that various changes and modifications may be made without departing from the spirit and scope of the invention as defined in the appended claims.

What is claimed is:

1. A high pressure fuel injection system for an internal combustion engine, comprising:

a fuel feed pump driven to pressurize fuel to a relatively low given feed pressure during the engine being operated, said fuel feed pump immediately allowed to be stopped when the engine is stopped;

a high pressure supply pump connected in series to said fuel feed pump for further pressurizing the fuel supplied from said fuel feed pump;

high pressure fuel storage means for storing the further pressurized fuel supplied from said high pressure supply pump;

a fuel injection valve supplied with the further pressurized fuel from said high pressure fuel storage means to inject it for supply to the engine; and a pressure relief valve connected to said high pressure fuel storage means, said pressure relief valve receiving said given feed pressure of the fuel from said fuel feed pump so as to be held closed during the engine being operated, while said pressure relief valve is opened, when the engine is stopped, in response to absence of said given feed pressure due to the stop of said fuel feed pump for dropping a pressure of the further-pressurized fuel in said high pressure fuel storage means.

2. The high pressure fuel injection system as set forth in claim 1, wherein said fuel feed pump is connected to a power source via a switch which is operated to energize said fuel feed pump when the engine is started and deenergize said fuel feed pump when the engine is stopped.

3. The high pressure fuel injection system as set forth in claim 1, wherein said pressure relief valve drops the pressure of the further pressurized fuel in said high pressure fuel storage means to a given low pressure when said pressure relief valve is opened.

4. The high pressure fuel injection system as set forth in claim 3, wherein said pressure relief valve, when it is opened, releases said pressure of the further pressurized fuel to a low pressure side via a valve mechanism which sets said given low pressure, so that said pressure of the further pressurized fuel is dropped to and held at said given low pressure while the engine is stopped.

5. The high pressure fuel injection system as set forth in claim 1, wherein said pressure relief valve includes a valve seat and a valve body which is separated from said valve seat to release said pressure of the further pressurized fuel in response to absence of said given feed pressure, while seated on said valve seat to prohibit said pressure release therethrough in response to said given feed pressure from said fuel feed pump, and wherein said valve body is fixed to a rotatable ball so as to be flitable relative to said valve seat.

* * * * *